US005461939A

United States Patent [19]

Upton

[11] Patent Number: 5,461,939

[45] Date of Patent: Oct. 31, 1995

[54] ADJUSTABLE PEDAL EXTENSION

[75] Inventor: Winfred R. Upton, Los Angeles, Calif.

[73] Assignee: Jesuit Community at Loyola University, Los Angeles, Calif.

[21] Appl. No.: 38,536

[22] Filed: Mar. 29, 1993

[51] Int. Cl.[6] ..... G05G 1/16; G05G 1/14

[52] U.S. Cl. ..... 74/562.5; 74/560; 74/562; 74/512

[58] Field of Search ..... 29/434; 74/560, 74/562, 562.5, 512, 513, 514

[56] References Cited

U.S. PATENT DOCUMENTS

| | | | |
|---|---|---|---|
| 2,597,379 | 5/1952 | Romel | 74/562.5 |
| 2,599,656 | 6/1952 | Ostrow | 74/562.5 |
| 2,791,915 | 5/1957 | Merry | 74/562.5 |
| 2,799,181 | 7/1957 | Speckman | 74/562.5 |
| 2,890,597 | 6/1959 | Allgaier | 74/562.5 |
| 3,174,359 | 3/1965 | Rose | 74/562.5 |
| 3,192,794 | 7/1965 | Counts | 74/562.5 |
| 3,626,785 | 12/1971 | Ross | 74/562 X |
| 3,661,033 | 5/1972 | Stantus | 74/562.5 |
| 3,943,795 | 3/1976 | Kenney | 74/560 X |
| 5,168,771 | 12/1992 | Fujimori | 74/562.5 |

OTHER PUBLICATIONS

Auxiliary Safety Brake Pedal, Safety Appliance Sales Co., P.O. Box 327, Altoona, Pa., Published Jan. 1954.

AAA Dual Controls, 1953.

*Primary Examiner*—Vinh T. Luong

*Attorney, Agent, or Firm*—Graham & James

[57] ABSTRACT

A pedal extension assembly for attaching to standard existing pedals. In the illustrated embodiment, sleeve bearings supported by a base connector rod are coupled to adjustable support bars which, in turn are pivotally coupled to adjustable extension bars. An extension pedal extends from one end of the extension bar, the opposite end of the adjustable extension bar being coupled via a pedal coupling plate to the standard, manufacturer-installed pedal. When the extension pedal is depressed, the standard pedal is equally depressed with a 1-to-1 displacement between the pedals.

7 Claims, 4 Drawing Sheets

ADJUSTABLE PEDAL EXTENSION

BACKGROUND OF THE INVENTION

1. Field of the Invention

The present invention relates to the modification of pedal assemblies, and more particularly, to the extension of standard pedals used for motor vehicle control.

2. Description of the Related Art

For those motorists who may be handicapped or small in stature, it is often difficult or uncomfortable to reach the brake and accelerator pedals of standard vehicles and drive safely. Typically in many standard automobiles, the driver's seat can be moved back and forth to provide adequate adjustment for the length of a motorist's legs. However, handicapped persons or those of small stature may still find that either the adjustability of the seat is not sufficient or that when their feet reach the pedals, the steering wheel nearly abuts the motorist's chest, significantly limiting steering capability.

Some extension devices include adjustable-height pedal extensions which are fixed at one end to the standard pedal of a vehicle and, at the other end, are provided with flat extension pedals which can be depressed by the operator. Such extension pedal assemblies often do not provide a 1-to-1 displacement ratio between the standard manufacturer-installed pedals and the extension pedal. Consequently, when the operator depresses the extension pedals, an equal amount of pressure is not transferred to the standard pedals.

In addition, because conventional pedal extension devices have generally been directed only to adding extensions to the individual existing pedal, if the pedals not being depressed, the operator's legs and feet dangle uncomfortably above the floor of the vehicle, eventually leading to increased discomfort and fatigue.

SUMMARY OF THE DISCLOSURE

It is an object of the present invention to provide an improved extension pedal for vehicles which over comes the above-mentioned limitations of the prior art, in a manner requiring a relatively uncomplicated mechanical arrangement.

In the discussion below, reference is made to the use of the present invention in the interior of standard automobiles. It is recognized, of course, that the pedal extension assembly according to embodiments of the present invention applies to a variety of other uses such as, for example, large trucks in which the height of the driver's seat is often uncomfortably high, boats, musical instruments such as drums, pianos, harps and organs, and other pedal-operated machinery.

These and other objects and advantages are achieved in an extension pedal assembly having, in accordance with the illustrated embodiments of the present invention, a rigid platform sized to fit on the floor of the driver's side of the vehicle, a connector rod carrying slidable sleeve bearing posts coupled to adjustable-length support linkages which, in turn, are coupled to adjustable pedal extension linkages that are pivotally attached to rigid coupling plates affixed or clamped to the standard manufacturer-installed pedals. The connection points between the connector rod and the adjustable support linkages, between the support linkages and the pedal extension linkages, and at the connections of the coupling plates to the pedal extension linkages are pivotally arranged such that the pedal extension assembly can be used with a variety of vehicles of different sizes having pedals that are separated from each other various distances.

Such an arrangement has been found to provide a vehicle pedal extension device having a particularly flexible design for easy installation and adaptation to many different vehicle configurations. In addition, the present invention provides a pedal extension assembly that displays a 1-to-1 displacement ratio such that the operator has the same control and feel of the extension pedals as if the standard accelerator, brake or clutch pedals were being engaged directly. Furthermore, because the arrangement of the present invention is portable, it may be used in rental cars, boats, and recreational vehicles.

DETAILED DESCRIPTION OF THE PREFERRED EMBODIMENTS

Figure 1:
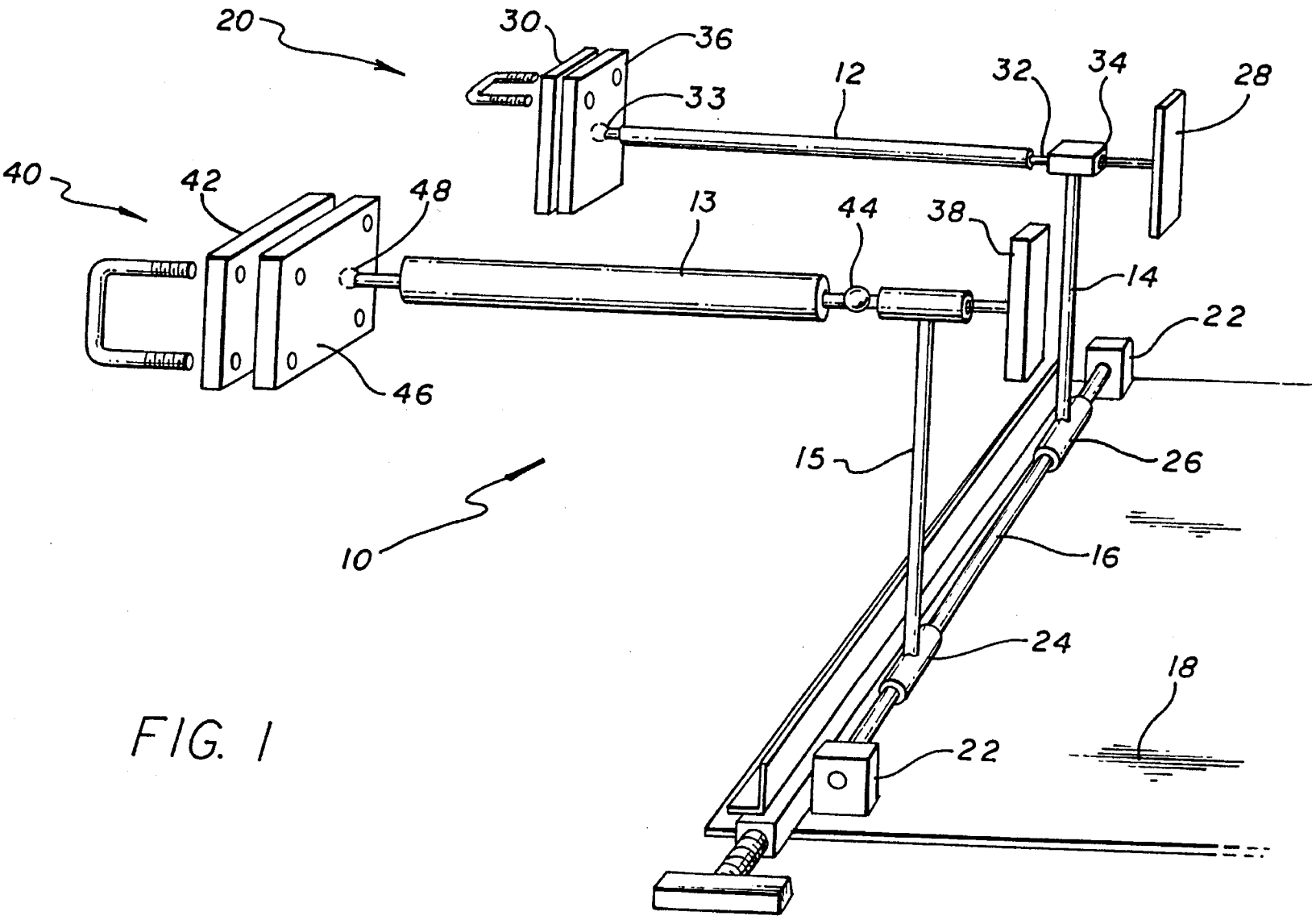
FIG. 1 is an exploded view of an automobile pedal extension assembly of a preferred embodiment of the present invention.

A vehicle pedal extension assembly in accordance with a preferred embodiment of the present invention is indicated generally at 10 in FIG. 1. In the illustrated embodiment, the pedal extension assembly 10 includes two sets 20 and 40 of adjustable-length linkages 12, 13 and 14, 15 connected together at angled joint assemblies 32 and 44, and a base connector rod 16. When the pedal extension assembly is implemented in a conventional vehicle, at least two pedal extension linkage arrangements may be necessary, e.g., at least for the accelerator pedal and the brake pedal. For other applications, there may be occasions when a third pedal extension linkage (e.g., for a clutch pedal) or only one pedal requires extension, for example, in a boat or if used with a sewing machine pedal. It will be recognized that further embodiments of the invention may include any suitable number of pedal extension linkages.

In the embodiment of the present invention illustrated in FIG. 1, the pedal extension assembly 10 includes a base connector rod 16 which interconnects pedal extension assemblies 20 and 40 for side-by-side pedals. A base platform 18 is provided to support the connector rod 16. Preferably, the platform 18 is sized to fit on the floor of the driver's side of the vehicle, and is wide enough to receive the base connector rod 16. The connector rod is held between opposing bearing support blocks 22 which may be secured to the platform by means of screws, bolts, adhesives or other suitable devices.

With respect to the accelerator pedal arrangement 20 as shown in FIG. 1, sleeve bearing 26 provides a rotatable joint between adjustable support linkage 14 and the base connector rod 16. The sleeve bearing 26 allows sufficient rotational motion of the support linkage 14 about the axis of the connector bar 16 to maintain a precise fit between the extension accelerator pedal 28 and the standard, manufacturer-installed pedal 30. As a result, for example, if the floor space in one vehicle is shorter or longer in length than another vehicle, the accelerator pedal extension arrangement 20 may still be used in both vehicles provided there is sufficient area for the adjustable support linkage 14 to rotate angularly about sleeve bearing 26 mounted on the base connector rod 16. The sleeve bearings are preferably fabricated from a brass material or other non-corrosive material.

Figure 2:
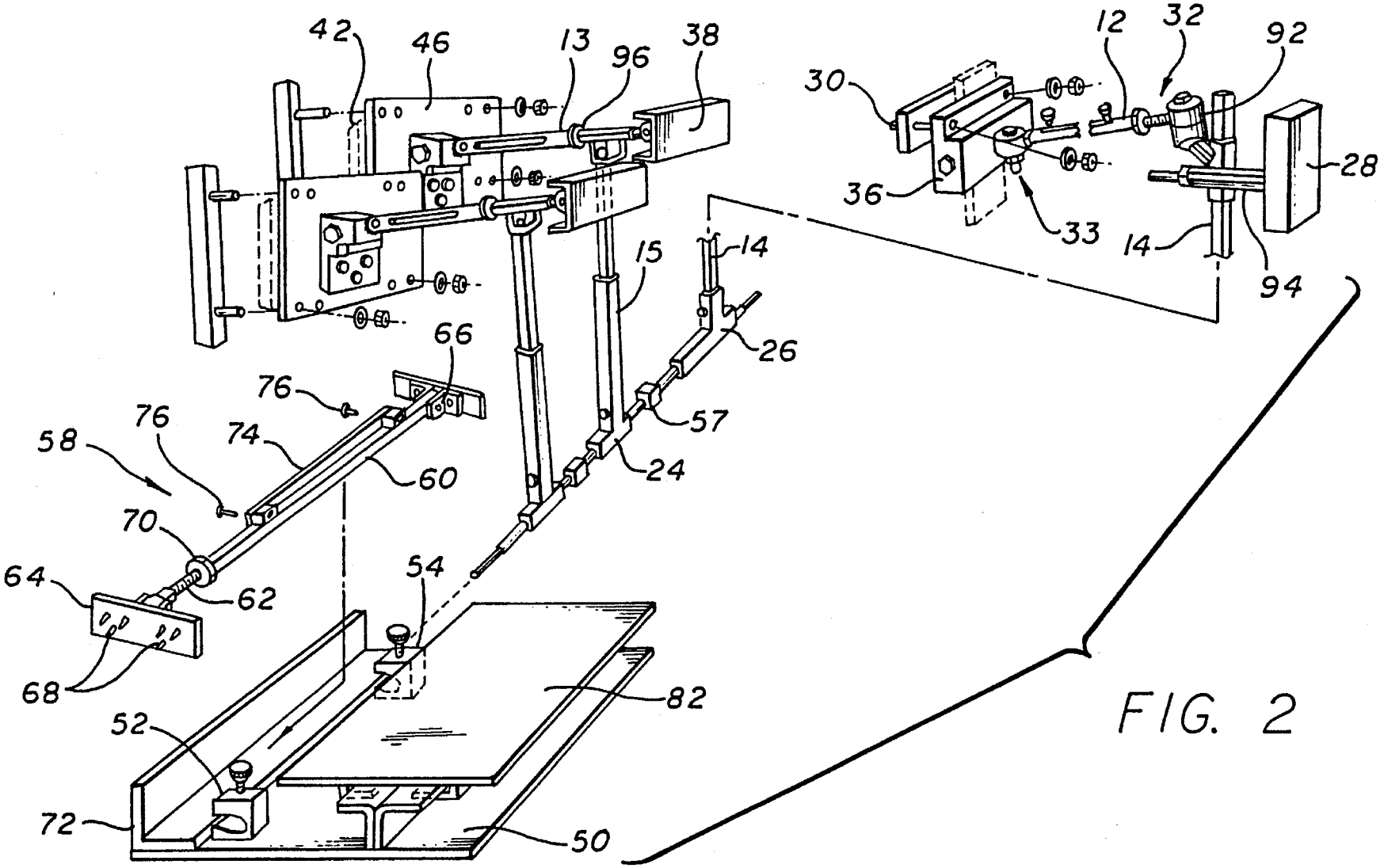
FIG. 2 is a more detailed partially exploded view of another preferred embodiment of the present invention.

The sleeve bearings are secured in place by slidable spacer bars 57 (shown in FIG. 2). The length of spacer bars 57 may be varied depending on the desired separation between the pedals, and according to the particular vehicle configuration. The spacer bars 57 may be anchored to connector rod 16 with set screws or other locking mechanism. In addition, the spacer bars 57 may be provided with aligning marks to properly position the support linkages 14, 15. Any remaining small discrepancies in alignment can then be overcome by the automatic alignment feature provided by pivot assemblies at the joints 33 and 48 between the pedal extension linkages 12, 13 and the coupling plates 36 and 46, and at joints 32 and 44 between the extension linkages 12, 13 and the support linkages 14, 15 as described in greater detail below.

Each adjustable support linkage 14, 15 is preferably fabricated from at least two telescoping, interlocking sections of square tubing in which one section fits slidably within the other, as shown in FIG. 2, to allow for extension and compression of the support linkages 14, 15. A locking bolt or other securing means may be used to lock the support linkages 14, 15 at a desired length. In the illustrated embodiment, the adjustable support linkages 14, 15 provides a vertical adjustment function, allowing the adjustment of the vertical height of the extension accelerator or brake pedals 28 or 38 relative to the platform 18.

It is recognized that the telescoping sections of tubing may have different cross-sectional shapes. In addition, other tube and rod arrangements may be used to provide an adjustable-length linkage bar. For example, the adjustable support linkages 14, 15 may be extended or compressed by means of a hydraulic assembly.

The adjustable pedal extension linkages 12, 13 are pivotally coupled to the adjustable support linkages 14, 15 at pivot joint 32. In the illustrated embodiment, the extension linkage 12 is limited to rotation about the axis of the support linkage 14 at joint 32 through a horizontal angle linkage adjustment assembly, shown in greater detail at 92 in FIG. 2. Preferably, the horizontal angle linkage adjustment assembly 92 is similar to the type of pivot joint used in conventional door assemblies in which the door swings about a cylindrical joint which allows pivoting motion about a central pin or bolt, along a horizontal plane.

In the illustrated embodiment, the pivot joints 32 and 33 provide a horizontal adjustment function, allowing the adjustment of the horizontal distance between the standard pedals 30 and 42 and the extension pedals 28 and 38. In this way, when the support linkage 14 has been extended to a desired height, if more precise adjustment is required between the distance from extension accelerator pedal 28 extending along the line of the extension linkage 12 to the standard pedal 30, the two pedals can be automatically aligned by means of the horizontal adjustment feature provided by the horizontal angle linkage adjustment assembly 92 at pivot joint 32. In the preferred embodiment, the extension accelerator pedal 28 is rigidly coupled to the joint 32 by a bolt extender assembly 94, as indicated in FIG. 2.

A pedal coupling plate 36 is pivotally attached to the end of the adjustable pedal extension linkage 12, opposite the extension pedal 28. The joint 33 between the pedal coupling plate and the extension linkage 12 may also be provided with a horizontal angle linkage adjustment assembly such as that shown at 92 in FIG. 2 and as described above with regard to joint 32. Preferably, the pedal coupling plate 36 is approximately the size of the existing, manufacturer-installed pedal 30 and may be secured to the standard existing pedal 30 by means of bolts or other clamping devices. As illustrated in FIG. 1, preferably one or more U-bolts are used to securely attach the coupling plate 36 to the standard pedal 30. However it is recognized that other secure clamping devices or adhesives may be implemented to provide a secure grip between the standard manufacturer-installed accelerator pedal 30 and the pedal coupling plate 36.

Like the support linkages 14, 15 the adjustable pedal extension linkages 12, 13 is preferably fabricated as a telescoping structure of tubing having any suitable cross sectional shape, preferably circular or square, which may be extended and compressed. The extension linkage can be locked into place by a locking nut arrangement, as indicated at 96 in FIG. 2, a set screw assembly, or other secure locking mechanism. For example, a pin/hole assembly may be used to quickly and discretely adjust the length of the linkages 12, 13 and 14, 15.

Once the extension linkage 12 is locked into a desired comfortable position, it does not further compress when force is applied to the extension pedal 28 during use. Consequently, the rigid extension linkage 12 provides accurate 1-to-1 displacement of the extension pedal 28 relative to the standard pedal 30, thereby providing a "real feel" of the pedal to the operator.

Extension arrangements for brake and clutch pedals, like the accelerator pedal assembly, also include adjustable support and extension linkages 13 and 15 coupled to the base connector rod 16, as shown in FIG. 1 (brake pedal only). With regard to the brake pedal assembly indicated generally at 40 in FIG. 1 the adjustable support linkage 15 is rigidly coupled to sleeve bearing 24. Sleeve bearing 24 is rotatably received over the base connector rod 16 such that support linkage 15 may rotate about the axis of the connector rod 16 to align the adjustable extension linkage 13 between the extension brake pedal 38 and the standard manufacturer-installed brake pedal 42.

As shown in FIG. 2 and as described above with regard to the accelerator pedal extension assembly 20, the adjustable support linkage 15 of the brake extension pedal assembly 40 is preferably fabricated from multiple sections of square tubing which slidably fit over each other in a telescoping manner to provide a desired extension or compression to reach a comfortable height for the operator. The sections of tubing are then locked in place with a set screw, locking bolt, pin/hole assembly, or other locking mechanism.

As illustrated in the embodiment of FIG. 1, the adjustable support linkage 15 is pivotally coupled to the extension linkage 13 at a pivot joint 44. The pivot joint assembly 44 allows sufficient rotational motion to provide precise automatic alignment between the extension pedal 38 and the standard brake pedal 42, while the linkages 13 and 15 are adjusted to the desired vertical and horizontal adjustment positions. Similar to the accelerator pedal assembly 20, the end of the adjustable extension linkage 13 opposite the pivot joint assembly 44 and extension brake pedal 38 is pivotally coupled to brake coupling plate 46 at pivot joint 48. Preferably, the brake coupling plate 46 is about the same size as the standard brake pedal 42 and is attached to the standard pedal 42 by means of bolts, clamps, or the like. In the illustrated embodiment of FIG. 1, the coupling plate 46 is secured to the standard vehicle pedal 42 with U-bolts. It is recognized however, that for purposes of simple installation and removal, e.g., for use in rental vehicles, a simply clamping mechanism may be desired to secure the coupling plate to the standard brake pedal 42.

The dual pivoting capability of the extension linkages 12, 13 between the pivot joints provides for automatic alignment of the extension pedals with the standard pedals. The interaction of the bearings, pivots, and adjustable-length rods allows users who may be handicapped or of small stature to drive a variety of standard vehicles. Because the extension brake and accelerator pedals are rigidly coupled to the sleeve bearings 24 and 26 mounted on the base connector rod 16 and are directly coupled to the standard manufacturer-installed brake and accelerator pedals 42 and 30, respectively, a 1-to-1 displacement is achieved when the pedals are depressed. Accordingly, as the operator applies pressure to either pedal, an equal amount of pressure is transferred to the standard pedals.

In a different aspect of the present invention and as illustrated in FIG. 2, a platform 50 is provided with bearing support blocks 52 and 54 which receive the base connector rod 16. The platform 50 is preferably fabricated from a rigid sheet of plastic or metal material, and is light enough to be portable for interchangeability between vehicles. The platform 50 may be secured to the floorboard of the vehicle by bolts or other means of attachment such as a suction device disposed on the bottom of the platform.

Figure 4:
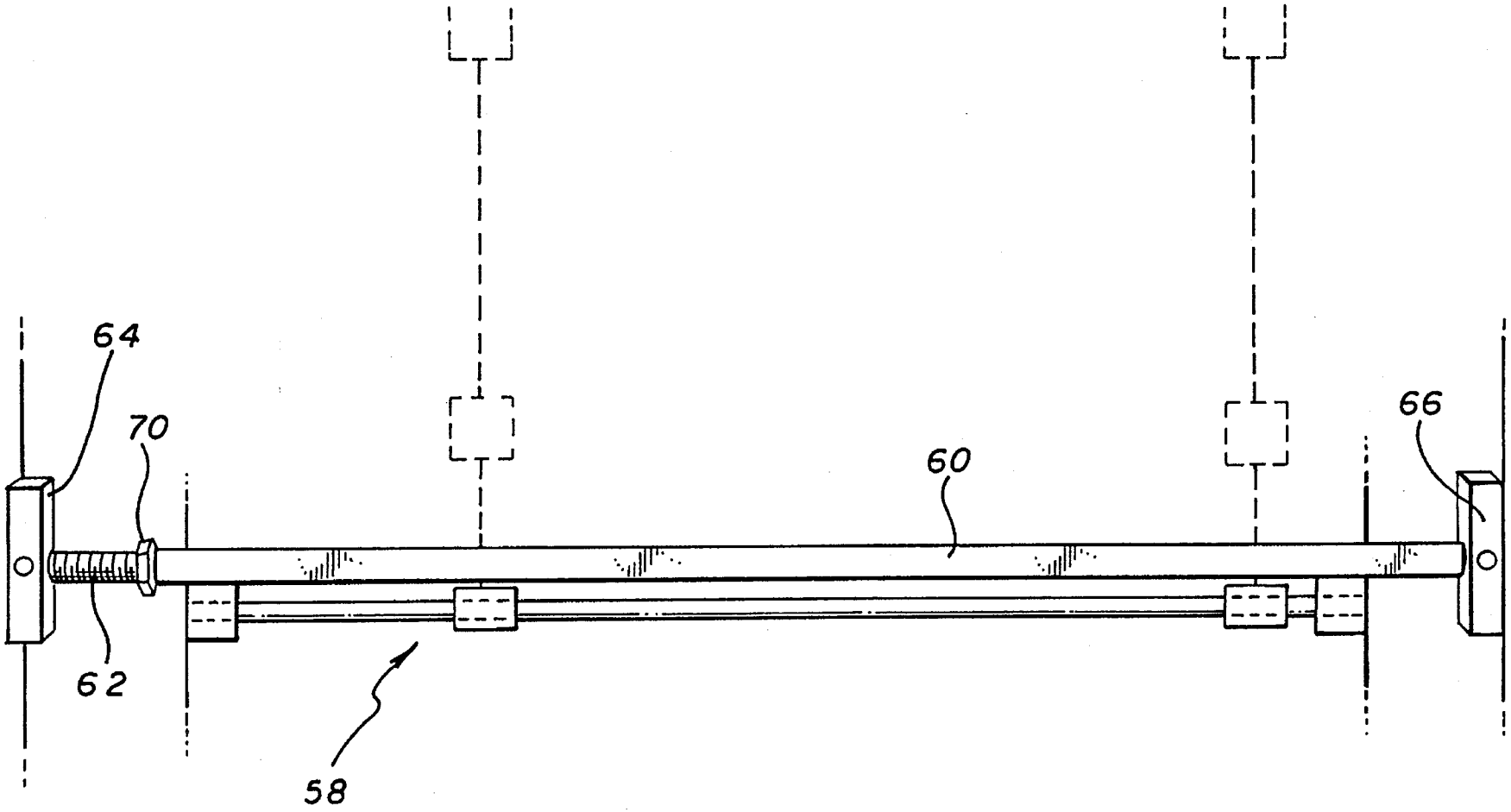
FIG. 4 is a perspective view of an optional wedge bar assembly in accordance with a preferred embodiment of the present invention.

Preferably, a wedge bar 58 (shown in greater detail in FIG. 4) is used to secure the platform to the floor of the driver's side of the vehicle. Referring to FIG. 4, in a preferred embodiment the wedge bar 58 is made of square tubing 60 which receives a continuous-threaded bolt 62 (also shown in FIG. 2). The ends of the wedge bar 58 are provided with flat wedge blocks 64 and 66. The illustrated embodiment of the wedge blocks 64 and 66 are provided with protruding non-slip pins 68 (FIG. 2) which engage the side walls of the driver's side of the vehicle. Other means for inhibiting slippage of the wedge blocks may be used in further embodiments, such as tread, ribs, teeth, or the like.

For example, the wedge block 64 may be wedged between the internal wall of the door and the center drive train hump in the floor of the vehicle that divides the driver's compartment from the passenger compartment. In cases where a center hump is not provided in a vehicle, a bolt assembly may be used. The wedge bar 58 is frictionally secured in place by tightening a lock nut 70 which prevents the tubing 60 from sliding over the bolt 62. Similarly, the bolt may be replaced by a large screw such that the length of the wedge bar 58 may be extended or compressed as the screw is rotated through the tubing.

The wedge bar 58 may be secured to the platform 50 by means of screws, bolts or the like in which the tubing 60 is fixed to the platform 50. Preferably, a strip of flat, rigid material 74, as indicated in FIG. 2, is secured to the wedge bar by means of screws 76 and can be directly bolted, screwed, or the like, to an angled bar 72 affixed to the platform 50. Again, it is recognized that various other means may be used to secure the wedge bar to the platform 50 to limit the movement of the platform 50 during use.

Figure 3:
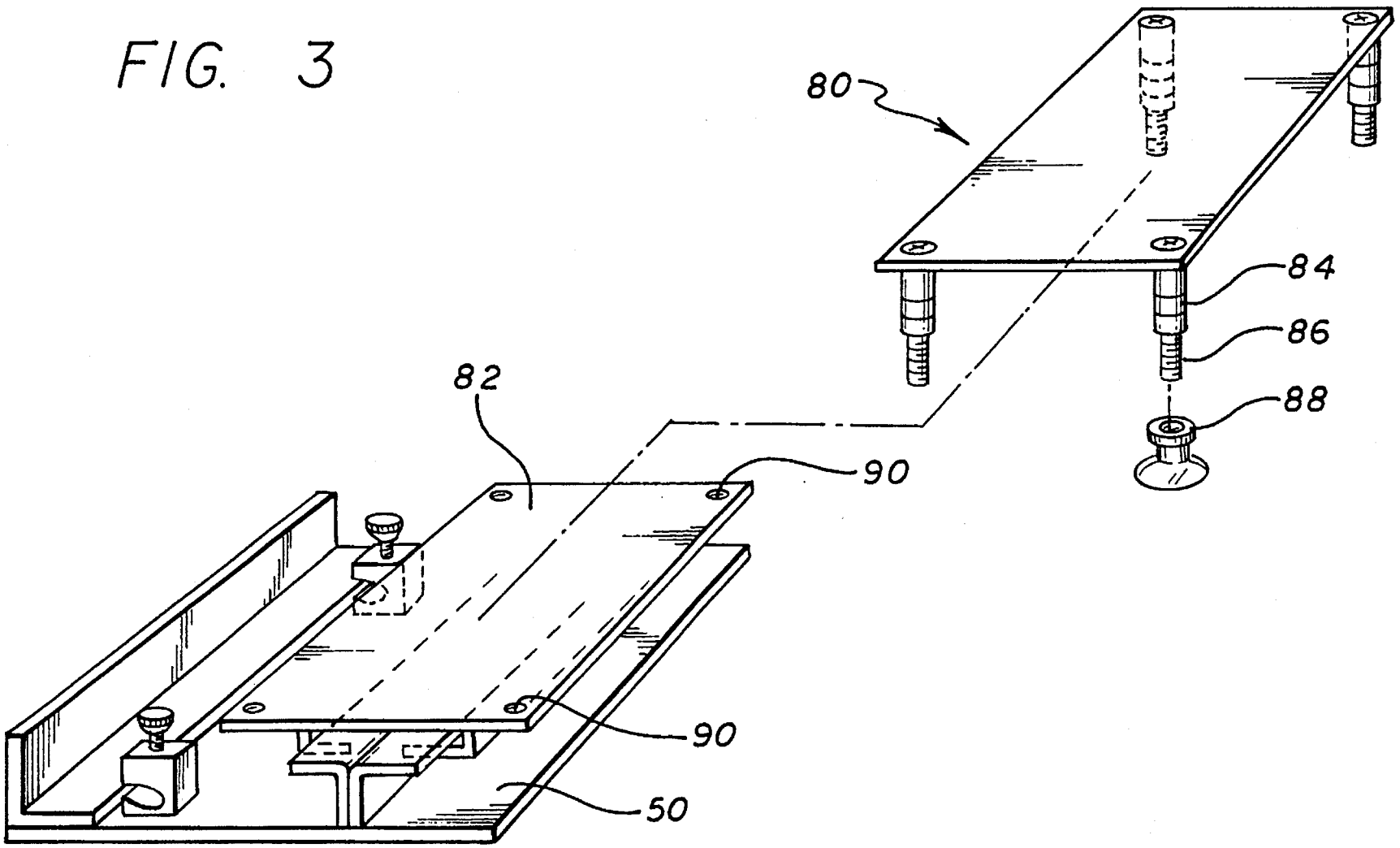
FIG. 3 is a partially exploded view of the platform of FIGS. 1 and 2, relative to an adjustable-height height footrest.

In another aspect of the present invention, as shown in FIG. 3, an elevated footrest adjustment plate 80 may be placed over the platform 50 and secured to a footrest 82. The footrest adjustment plate 80 is preferably secured to the footrest 82 by means of screws or bolts 86 positioned along the perimeter or at the corners of the footrest adjustment plate 80. In the preferred embodiment, the elevation of the footrest adjustment plate 80 is determined by the length of spacers 84 mounted over the bolts 86. For example, as illustrated in FIG. 3, bolt 86 is received by a spacer 84 having a larger external circumference than the aperture. The remaining threaded section of the bolt may be screwed into the apertures 90 in the footrest 82 and tightened to securely fix the footrest adjustment plate 80 to the platform assembly. In this way, during operation of the vehicle with the pedal extension assembly in place, the operator's feet will not dangle above the floorboard of the vehicle, but may rest comfortably on the footrest assembly. It is recognized that other elevation devices may be used to support the footrest adjustment plate 80 over the platform 50 with or without the footrest 82, or the footrest 82 may be used alone.

It is seen from the above that embodiments of the present invention provide a unique pedal extension assembly for vehicles which can be easily installed in a vehicle when needed, yet is inexpensive to manufacture and may be quickly removed. It will, of course, be understood that modifications of the present invention, in its various aspects, will be apparent to those skilled in the art, some being apparent only after study and others being matters of routine mechanical design. For example, the pedal extension assembly 10 may include extension levers for a foot-operated parking brake, or for a clutch pedal in addition to the brake and accelerator pedals as described above.

Other embodiments are also possible, their specific designs depending upon the particular application. As such, the scope of the invention should not be limited by the particular embodiment herein described but should be defined only by the appended claims and equivalents thereof.

What is claimed is:

1. A pedal extension device operable with existing pedals in a vehicle, comprising:

a connector member;

at least one support linkage pivotally coupled to the connector member;

an extension linkage associated with each support linkage and each existing pedal, the extension linkage being pivotally coupled between an associated support linkage and an existing pedal, wherein the extension and support linkages are adjustable in length;

an extension pedal associated with each extension linkage, the extension pedal extending from each extension linkage opposite each associated existing pedal;

a platform assembly including a platform base coupled to the connector member, and securing means for rigidly fixing the platform base to the floor of the vehicle, wherein the securing means comprises suction means disposed on the bottom of the platform base.

2. The pedal extension device of claim 1, wherein the platform assembly further includes a footrest assembly arranged atop the platform base.

3. The pedal extension device of claim 2, wherein the footrest assembly includes means for adjusting a height of the footrest to accommodate operators having different leg lengths.

4. The pedal extension device of claim 1, wherein each extension linkage and each support linkage include an adjustable structure comprising:

a slidable rod, a hollow rod for receiving the slidable rod, the slidable rod being slidably and adjustably connectible to the hollow rod to vary a length of at least one of a respective extension linkage and a respective support linkage; and locking means for locking the slidable rod and the hollow rod together at a desired location.

5. The pedal extension device of claim 1, wherein the platform base includes first and second bearing supports for receiving the connector member.

6. A pedal extension device operable with existing pedals in a vehicle, comprising:

a connector member;

at least one support linkage pivotally coupled to the connector member;

an extension linkage associated with each support linkage and each existing pedal, the extension linkage being pivotally coupled between the associated support linkage and existing pedal, wherein the extension and support linkages are adjustable in length;

an extension pedal associated with each extension linkage, the extension pedal extending from each extension linkage opposite each associated existing pedal;

a platform assembly including a platform base coupled to the connector member, and securing means for rigidly fixing the platform base to the floor of the vehicle, the platform assembly further including a footrest assembly arranged atop the base platform, wherein the footrest assembly comprises:

an elevated footrest plate;

attachment means for securely attaching the elevated footrest plate to the platform base; and spacer means for receiving the attachment means, wherein a length of the spacer means determines an elevation of the elevated footrest plate atop the platform base.

7. The pedal extension device of claim 6, wherein the securing means comprises an elongated assembly including:

a hollow tube, a rod member slidably received by the hollow tube, locking means for locking the rod member in connection with the hollow tube at a desired length, and a plurality of wedge blocks coupled to the hollow external tube and rod member, wherein the elongated assembly frictionally secure the plurality of wedge blocks to the vehicle.

* * * * *